US009296082B1

(12) United States Patent
Kesvanathan et al.

(10) Patent No.: US 9,296,082 B1
(45) Date of Patent: Mar. 29, 2016

(54) DISK BUFFING APPARATUS WITH ABRASIVE TAPE LOADING PAD HAVING A VIBRATION ABSORBING LAYER

(71) Applicant: WD Media, LLC, San Jose, CA (US)

(72) Inventors: Prem Kumar Kesvanathan, Penang (MY); Shaun H. Chen, Cupertino, CA (US)

(73) Assignee: WD Media, LLC, San Jose, CA (US)

( * ) Notice: Subject to any disclaimer, the term of this patent is extended or adjusted under 35 U.S.C. 154(b) by 23 days.

(21) Appl. No.: 14/097,137

(22) Filed: Dec. 4, 2013

Related U.S. Application Data

(60) Provisional application No. 61/833,904, filed on Jun. 11, 2013.

(51) Int. Cl.

| | |
|---|---|
| ***B24B 21/02*** | (2006.01) |
| ***B24B 21/04*** | (2006.01) |
| ***B24B 21/08*** | (2006.01) |
| ***B24B 27/00*** | (2006.01) |

(52) U.S. Cl.
CPC ..... *B24B 21/08* (2013.01); *B24B 21/02* (2013.01); *B24B 21/04* (2013.01); *B24B 27/0076* (2013.01)

(58) Field of Classification Search
CPC ..... B24B 21/00; B24B 21/02; B24B 21/06; B24B 21/08; B24B 21/10; B24B 21/12; B24B 21/14
USPC ..... 451/41, 59, 296, 299, 302, 303, 307
See application file for complete search history.

(56) References Cited

U.S. PATENT DOCUMENTS

| | | | | |
|---|---|---|---|---|
| 4,412,400 | A | | 11/1983 | Hammond |
| 4,514,937 | A | * | 5/1985 | Gehrung et al. ..... 451/28 |
| 4,656,790 | A | | 4/1987 | Mukai et al. |
| 4,845,816 | A | | 7/1989 | Nanis |
| 5,012,618 | A | * | 5/1991 | Price et al. ..... 451/302 |
| 5,018,311 | A | * | 5/1991 | Malagrino et al. ..... 451/302 |
| 5,099,615 | A | * | 3/1992 | Ruble et al. ..... 451/5 |
| 5,431,592 | A | * | 7/1995 | Nakata ..... 451/63 |
| 5,443,415 | A | * | 8/1995 | Shebanow et al. ..... 451/302 |
| 5,733,179 | A | | 3/1998 | Bauer |
| 5,820,446 | A | * | 10/1998 | Lu ..... 451/37 |
| 5,954,566 | A | | 9/1999 | Bauer |
| 6,013,161 | A | | 1/2000 | Chen et al. |
| 6,063,248 | A | | 5/2000 | Bourez et al. |
| 6,068,891 | A | | 5/2000 | O'Dell et al. |
| 6,086,730 | A | | 7/2000 | Liu et al. |
| 6,099,981 | A | | 8/2000 | Nishimori |
| 6,103,404 | A | | 8/2000 | Ross et al. |
| 6,117,499 | A | | 9/2000 | Wong et al. |
| 6,136,403 | A | | 10/2000 | Prabhakara et al. |
| 6,143,375 | A | | 11/2000 | Ross et al. |
| 6,145,849 | A | | 11/2000 | Bae et al. |
| 6,146,737 | A | | 11/2000 | Malhotra et al. |
| 6,149,696 | A | | 11/2000 | Jia |

(Continued)

*Primary Examiner* — Eileen Morgan

(57) ABSTRACT

A disk buffing apparatus includes a spindle for rotating an annular disk, and a first pad arm for loading a first abrasive tape against a first surface of the annular disk. The first pad arm includes a pad arm frame having a pad receptacle and a first pad. The first pad has a first damping layer in contact with the first pad arm within the pad receptacle, and a first tape loading layer for contacting the first abrasive tape. The first damping layer comprises a first polymeric material and the first tape loading layer comprises a second polymeric material. The first polymeric material has a lesser hardness than the second polymeric material.

20 Claims, 5 Drawing Sheets

(56) References Cited

U.S. PATENT DOCUMENTS 6,150,015 A 11/2000 Bertero et al.
6,156,404 A 12/2000 Ross et al.
6,159,076 A 12/2000 Sun et al.
6,164,118 A 12/2000 Suzuki et al.
6,168,831 B1 1/2001 Khan et al.
6,200,441 B1 3/2001 Gornicki et al.
6,204,995 B1 3/2001 Hokkyo et al.
6,206,765 B1 3/2001 Sanders et al.
6,210,819 B1 4/2001 Lal et al.
6,216,709 B1 4/2001 Fung et al.
6,221,119 B1 4/2001 Homola
6,248,395 B1 6/2001 Homola et al.
6,261,681 B1 7/2001 Suekane et al.
6,270,885 B1 8/2001 Hokkyo et al.
6,274,063 B1 8/2001 Li et al.
6,283,838 B1 * 9/2001 Blake et al. ..... 451/63
6,287,429 B1 9/2001 Moroishi et al.
6,290,573 B1 * 9/2001 Suzuki ..... 451/8
6,299,947 B1 10/2001 Suzuki et al.
6,303,217 B1 10/2001 Malhotra et al.
6,309,765 B1 10/2001 Suekane et al.
6,358,636 B1 3/2002 Yang et al.
6,362,452 B1 3/2002 Suzuki et al.
6,363,599 B1 4/2002 Bajorek
6,365,012 B1 4/2002 Sato et al.
6,381,090 B1 4/2002 Suzuki et al.
6,381,092 B1 4/2002 Suzuki
6,387,483 B1 5/2002 Hokkyo et al.
6,391,213 B1 5/2002 Homola
6,395,349 B1 5/2002 Salamon
6,403,919 B1 6/2002 Salamon
6,408,677 B1 6/2002 Suzuki
6,408,678 B1 6/2002 Chopra et al.
6,426,157 B1 7/2002 Hokkyo et al.
6,429,984 B1 8/2002 Alex
6,482,330 B1 11/2002 Bajorek
6,482,505 B1 11/2002 Bertero et al.
6,500,567 B1 12/2002 Bertero et al.
6,528,124 B1 3/2003 Nguyen
6,548,821 B1 4/2003 Treves et al.
6,552,871 B2 4/2003 Suzuki et al.
6,565,719 B1 5/2003 Lairson et al.
6,566,674 B1 5/2003 Treves et al.
6,571,806 B2 6/2003 Rosano et al.
6,592,435 B2 7/2003 Kishima
6,628,466 B2 9/2003 Alex
6,664,503 B1 12/2003 Hsieh et al.
6,670,055 B2 12/2003 Tomiyasu et al.
6,682,807 B2 1/2004 Lairson et al.
6,683,754 B2 1/2004 Suzuki et al.
6,730,420 B1 5/2004 Bertero et al.
6,743,528 B2 6/2004 Suekane et al.
6,746,320 B2 6/2004 Krusell et al.
6,759,138 B2 7/2004 Tomiyasu et al.
6,778,353 B1 8/2004 Harper
6,795,274 B1 9/2004 Hsieh et al.
6,821,189 B1 11/2004 Coad et al.
6,855,232 B2 2/2005 Jairson et al.
6,857,937 B2 2/2005 Bajorek
6,893,329 B2 5/2005 Tajima et al.
6,893,748 B2 5/2005 Bertero et al.
6,899,959 B2 5/2005 Bertero et al.
6,916,558 B2 7/2005 Umezawa et al.
6,939,120 B1 9/2005 Harper
6,946,191 B2 9/2005 Morikawa et al.
6,967,798 B2 11/2005 Homola et al.
6,972,135 B2 12/2005 Homola
7,001,074 B2 2/2006 Dittmer et al.
7,004,827 B1 2/2006 Suzuki et al.
7,006,323 B1 2/2006 Suzuki
7,016,154 B2 3/2006 Nishihira
7,019,924 B2 3/2006 McNeil et al.
7,045,215 B2 5/2006 Shimokawa
7,070,870 B2 7/2006 Bertero et al.
7,090,934 B2 8/2006 Hokkyo et al.
7,099,112 B1 8/2006 Harper
7,105,241 B2 9/2006 Shimokawa et al.
7,119,990 B2 10/2006 Bajorek et al.
7,147,790 B2 12/2006 Wachenschwanz et al.
7,161,753 B2 1/2007 Wachenschwanz et al.
7,166,319 B2 1/2007 Ishiyama
7,166,374 B2 1/2007 Suekane et al.
7,169,487 B2 1/2007 Kawai et al.
7,174,775 B2 2/2007 Ishiyama
7,179,549 B2 2/2007 Malhotra et al.
7,184,139 B2 2/2007 Treves et al.
7,196,860 B2 3/2007 Alex
7,199,977 B2 4/2007 Suzuki et al.
7,208,236 B2 4/2007 Morikawa et al.
7,220,500 B1 5/2007 Tomiyasu et al.
7,229,266 B2 6/2007 Harper
7,239,970 B2 7/2007 Treves et al.
7,252,897 B2 8/2007 Shimokawa et al.
7,277,254 B2 10/2007 Shimokawa et al.
7,281,920 B2 10/2007 Homola et al.
7,292,329 B2 11/2007 Treves et al.
7,301,726 B1 11/2007 Suzuki
7,302,148 B2 11/2007 Treves et al.
7,305,119 B2 12/2007 Treves et al.
7,314,404 B2 1/2008 Singh et al.
7,320,584 B1 1/2008 Harper et al.
7,329,114 B2 2/2008 Harper et al.
7,367,873 B2 * 5/2008 Ishii et al. ..... 451/168
7,375,362 B2 5/2008 Treves et al.
7,420,886 B2 9/2008 Tomiyasu et al.
7,425,719 B2 9/2008 Treves et al.
7,471,484 B2 12/2008 Wachenschwanz et al.
7,498,062 B2 3/2009 Calcaterra et al.
7,531,485 B2 5/2009 Hara et al.
7,537,846 B2 5/2009 Ishiyama et al.
7,549,209 B2 6/2009 Wachenschwanz et al.
7,569,490 B2 8/2009 Staud
7,597,792 B2 10/2009 Homola et al.
7,597,973 B2 10/2009 Ishiyama
7,608,193 B2 10/2009 Wachenschwanz et al.
7,632,087 B2 12/2009 Homola
7,656,615 B2 2/2010 Wachenschwanz et al.
7,682,546 B2 3/2010 Harper
7,684,152 B2 3/2010 Suzuki et al.
7,686,606 B2 3/2010 Harper et al.
7,686,991 B2 3/2010 Harper
7,695,833 B2 4/2010 Ishiyama
7,722,968 B2 5/2010 Ishiyama
7,733,605 B2 6/2010 Suzuki et al.
7,736,768 B2 6/2010 Ishiyama
7,755,861 B1 7/2010 Li et al.
7,758,732 B1 7/2010 Calcaterra et al.
7,833,639 B2 11/2010 Sonobe et al.
7,833,641 B2 11/2010 Tomiyasu et al.
7,910,159 B2 3/2011 Jung
7,911,736 B2 3/2011 Bajorek
7,924,519 B2 4/2011 Lambert
7,944,165 B1 5/2011 O'Dell
7,944,643 B1 5/2011 Jiang et al.
7,955,723 B2 6/2011 Umezawa et al.
7,983,003 B2 7/2011 Sonobe et al.
7,993,497 B2 8/2011 Moroishi et al.
7,993,765 B2 8/2011 Kim et al.
7,998,912 B2 8/2011 Chen et al.
8,002,901 B1 8/2011 Chen et al.
8,003,237 B2 8/2011 Sonobe et al.
8,012,920 B2 9/2011 Shimokawa
8,038,863 B2 10/2011 Homola
8,057,926 B2 11/2011 Ayama et al.
8,062,778 B2 11/2011 Suzuki et al.
8,064,156 B1 11/2011 Suzuki et al.
8,076,013 B2 12/2011 Sonobe et al.
8,092,931 B2 1/2012 Ishiyama et al.
8,100,685 B1 1/2012 Harper et al.
8,101,054 B2 1/2012 Chen et al.
8,125,723 B1 2/2012 Nichols et al.
8,125,724 B1 2/2012 Nichols et al.
8,137,517 B1 3/2012 Bourez
8,142,916 B2 3/2012 Umezawa et al.

(56) References Cited

U.S. PATENT DOCUMENTS 8,163,093 B1 4/2012 Chen et al.
8,171,949 B1 5/2012 Lund et al.
8,173,282 B1 5/2012 Sun et al.
8,178,480 B2 5/2012 Hamakubo et al.
8,206,789 B2 6/2012 Suzuki
8,218,260 B2 7/2012 Iamratanakul et al.
8,247,095 B2 8/2012 Champion et al.
8,257,783 B2 9/2012 Suzuki et al.
8,298,609 B1 10/2012 Liew et al.
8,298,689 B2 10/2012 Sonobe et al.
8,309,239 B2 11/2012 Umezawa et al.
8,316,668 B1 11/2012 Chan et al.
8,331,056 B2 12/2012 O'Dell
8,354,618 B1 1/2013 Chen et al.
8,367,228 B2 2/2013 Sonobe et al.
8,383,209 B2 2/2013 Ayama
8,393,935 B2 * 3/2013 Kimura et al. ..... 451/168
8,394,243 B1 3/2013 Jung et al.
8,397,751 B1 3/2013 Chan et al.
8,399,809 B1 3/2013 Bourez
8,402,638 B1 3/2013 Treves et al.
8,404,056 B1 3/2013 Chen et al.
8,404,369 B2 3/2013 Ruffini et al.
8,404,370 B2 3/2013 Sato et al.
8,406,918 B2 3/2013 Tan et al.
8,414,966 B2 4/2013 Yasumori et al.
8,425,975 B2 4/2013 Ishiyama
8,431,257 B2 4/2013 Kim et al.
8,431,258 B2 4/2013 Onoue et al.
8,453,315 B2 6/2013 Kajiwara et al.
8,488,276 B1 7/2013 Jung et al.
8,491,800 B1 7/2013 Dorsey
8,492,009 B1 7/2013 Homola et al.
8,492,011 B2 7/2013 Itoh et al.
8,496,466 B1 7/2013 Treves et al.
8,517,364 B1 8/2013 Crumley et al.
8,517,657 B2 8/2013 Chen et al.
8,524,052 B1 9/2013 Tan et al.
8,530,065 B1 9/2013 Chernyshov et al.
8,546,000 B2 10/2013 Umezawa
8,551,253 B2 10/2013 Na'im et al.
8,551,627 B2 10/2013 Shimada et al.
8,556,566 B1 10/2013 Suzuki et al.
8,559,131 B2 10/2013 Masuda et al.
8,562,748 B1 10/2013 Chen et al.
8,565,050 B1 10/2013 Bertero et al.
8,570,844 B1 10/2013 Yuan et al.
8,580,410 B2 11/2013 Onoue
8,584,687 B1 11/2013 Chen et al.
8,591,709 B1 11/2013 Lim et al.
8,592,061 B2 11/2013 Onoue et al.
8,596,287 B1 12/2013 Chen et al.
8,597,723 B1 12/2013 Jung et al.
8,603,649 B2 12/2013 Onoue
8,603,650 B2 12/2013 Sonobe et al.
8,605,388 B2 12/2013 Yasumori et al.
8,605,555 B1 12/2013 Chernyshov et al.
8,608,147 B1 12/2013 Yap et al.
8,609,263 B1 12/2013 Chernyshov et al.
8,619,381 B2 12/2013 Moser et al.
8,623,528 B2 1/2014 Umezawa et al.
8,623,529 B2 1/2014 Suzuki
8,634,155 B2 1/2014 Yasumori et al.
8,658,003 B1 2/2014 Bourez
8,658,292 B1 2/2014 Mallary et al.
8,665,541 B2 3/2014 Saito
8,668,953 B1 3/2014 Buechel-Rimmel
8,674,327 B1 3/2014 Poon et al.
8,685,214 B1 4/2014 Moh et al.
8,821,218 B2 * 9/2014 Luu et al. ..... 451/168
2001/0011002 A1 * 8/2001 Steere, III ..... 451/168
2002/0060883 A1 5/2002 Suzuki
2003/0022024 A1 1/2003 Wachenschwanz
2004/0022387 A1 2/2004 Weikle
2004/0132301 A1 7/2004 Harper et al.
2004/0202793 A1 10/2004 Harper et al.
2004/0202865 A1 10/2004 Homola et al.
2004/0209123 A1 10/2004 Bajorek et al.
2004/0209470 A1 10/2004 Bajorek
2005/0036223 A1 2/2005 Wachenschwanz et al.
2005/0056303 A1 3/2005 Lee et al.
2005/0142990 A1 6/2005 Homola
2005/0150862 A1 7/2005 Harper et al.
2005/0151282 A1 7/2005 Harper et al.
2005/0151283 A1 7/2005 Bajorek et al.
2005/0151300 A1 7/2005 Harper et al.
2005/0155554 A1 7/2005 Saito
2005/0167867 A1 8/2005 Bajorek et al.
2005/0263401 A1 12/2005 Olsen et al.
2006/0130874 A1 6/2006 Lee et al.
2006/0147758 A1 7/2006 Jung et al.
2006/0181697 A1 8/2006 Treves et al.
2006/0207890 A1 9/2006 Staud
2007/0070549 A1 3/2007 Suzuki et al.
2007/0202260 A1 8/2007 Ito et al.
2007/0245909 A1 10/2007 Homola
2008/0075845 A1 3/2008 Sonobe et al.
2008/0093760 A1 4/2008 Harper et al.
2009/0117408 A1 5/2009 Umezawa et al.
2009/0136784 A1 5/2009 Suzuki et al.
2009/0169922 A1 7/2009 Ishiyama
2009/0191331 A1 7/2009 Umezawa et al.
2009/0202866 A1 8/2009 Kim et al.
2009/0311557 A1 12/2009 Onoue et al.
2010/0003900 A1 * 1/2010 Sakaguchi et al. ..... 451/59
2010/0003901 A1 1/2010 Sakaguchi et al.
2010/0143752 A1 6/2010 Ishibashi et al.
2010/0190035 A1 7/2010 Sonobe et al.
2010/0196619 A1 8/2010 Ishiyama
2010/0196740 A1 8/2010 Ayama et al.
2010/0209601 A1 8/2010 Shimokawa et al.
2010/0215992 A1 8/2010 Horikawa et al.
2010/0232065 A1 9/2010 Suzuki et al.
2010/0247965 A1 9/2010 Onoue
2010/0261039 A1 10/2010 Itoh et al.
2010/0279151 A1 11/2010 Sakamoto et al.
2010/0300884 A1 12/2010 Homola et al.
2010/0304186 A1 12/2010 Shimokawa
2011/0097603 A1 4/2011 Onoue
2011/0097604 A1 4/2011 Onoue
2011/0171495 A1 7/2011 Tachibana et al.
2011/0206947 A1 8/2011 Tachibana et al.
2011/0212346 A1 9/2011 Onoue et al.
2011/0223446 A1 9/2011 Onoue et al.
2011/0244119 A1 10/2011 Umezawa et al.
2011/0299194 A1 12/2011 Aniya et al.
2011/0311841 A1 12/2011 Saito et al.
2012/0069466 A1 3/2012 Okamoto et al.
2012/0070692 A1 3/2012 Sato et al.
2012/0077060 A1 3/2012 Ozawa
2012/0127599 A1 5/2012 Shimokawa et al.
2012/0127601 A1 5/2012 Suzuki et al.
2012/0129009 A1 5/2012 Sato et al.
2012/0140359 A1 6/2012 Tachibana
2012/0141833 A1 6/2012 Umezawa et al.
2012/0141835 A1 6/2012 Sakamoto
2012/0148875 A1 6/2012 Hamakubo et al.
2012/0156523 A1 6/2012 Seki et al.
2012/0164488 A1 6/2012 Shin et al.
2012/0170152 A1 7/2012 Sonobe et al.
2012/0171369 A1 7/2012 Koike et al.
2012/0175243 A1 7/2012 Fukuura et al.
2012/0189872 A1 7/2012 Umezawa et al.
2012/0196049 A1 8/2012 Azuma et al.
2012/0207919 A1 8/2012 Sakamoto et al.
2012/0225217 A1 9/2012 Itoh et al.
2012/0251842 A1 10/2012 Yuan et al.
2012/0251846 A1 10/2012 Desai et al.
2012/0276417 A1 11/2012 Shimokawa et al.
2012/0308722 A1 12/2012 Suzuki et al.
2013/0040167 A1 2/2013 Alagarsamy et al.

(56) References Cited

U.S. PATENT DOCUMENTS

| | | | | |
|---|---|---|---|---|
| 2013/0071694 | A1 | 3/2013 | Srinivasan et al. | |
| 2013/0165029 | A1 | 6/2013 | Sun et al. | |
| 2013/0175252 | A1 | 7/2013 | Bourez | |
| 2013/0216865 | A1 | 8/2013 | Yasumori et al. | |
| 2013/0230647 | A1 | 9/2013 | Onoue et al. | |
| 2013/0314815 | A1 | 11/2013 | Yuan et al. | |
| 2013/0344776 | A1* | 12/2013 | Sakaguchi | 451/59 |
| 2014/0011054 | A1 | 1/2014 | Suzuki | |
| 2014/0044992 | A1 | 2/2014 | Onoue | |
| 2014/0050843 | A1 | 2/2014 | Yi et al. | |

* cited by examiner

DISK BUFFING APPARATUS WITH ABRASIVE TAPE LOADING PAD HAVING A VIBRATION ABSORBING LAYER

CROSS-REFERENCE TO RELATED APPLICATION

This application claims priority to provisional U.S. Patent Application Ser. No. 61/833,904, filed on Jun. 11, 2013, which is hereby incorporated by reference in its entirety.

BACKGROUND

Information storage devices are used to retrieve and/or store data in computers and other consumer electronics devices. A disk drive is an example of an information storage device that includes one or more heads that can both read and write to a spinning disk media, but other information storage devices also include heads—sometimes including heads that cannot write.

The typical disk drive includes a head disk assembly (HDA) and a printed circuit board (PCB) attached to a disk drive base of the HDA. The HDA includes at least one disk (such as a magnetic disk, magneto-optical disk, or optical disk), a spindle motor for rotating the disk, and a head stack assembly (HSA). The spindle motor typically includes a rotating hub on which disks are mounted and clamped, a magnet attached to the hub, and a stator.

In magnetic recording applications, the disk includes a magnetic coating upon which the head performs read and write operations at a very close physical spacing. In optical and magneto-optical recording applications, the read head may include a mirror and an objective lens for focusing laser light on an adjacent disk surface.

In all of these applications, the flatness and smoothness of the disk is an important consideration. For example, in magnetic recording operations, the head must operate in very close proximity to the disk surface without frequent contact. The media layer of an optical disk may also have continuity and uniformity requirements that affect the specification of acceptable disk flatness and disk smoothness. Such specifications, in turn, can affect the requirements for manufacture of disks for information storage devices.

In certain disk manufacturing processes, a disk buffing apparatus is used to buff the surface of disks under manufacture with an abrasive tape, to thereby desirably affect disk surface characteristics. Conventionally, the disk buffing apparatus loads the abrasive tape on to the surface of the disk under manufacture by pressure applied through a tape loading pad.

However, a detrimental vibration is often observed, in which the tape and tape loading pad can bounce on the surface of the disk (e.g. a stick-slip phenomena) while the disk is spinning during the buffing process. Such vibration can be detrimental because if it is excessive then it can lead to degradation of the tape or disk surface quality and/or ultimately even undesired scratches on the disk surface. Thus, there is a need in the art for a disk buffing apparatus and method that can reduce undesired vibrations.

DETAILED DESCRIPTION OF EXEMPLARY EMBODIMENTS

Figure 1:
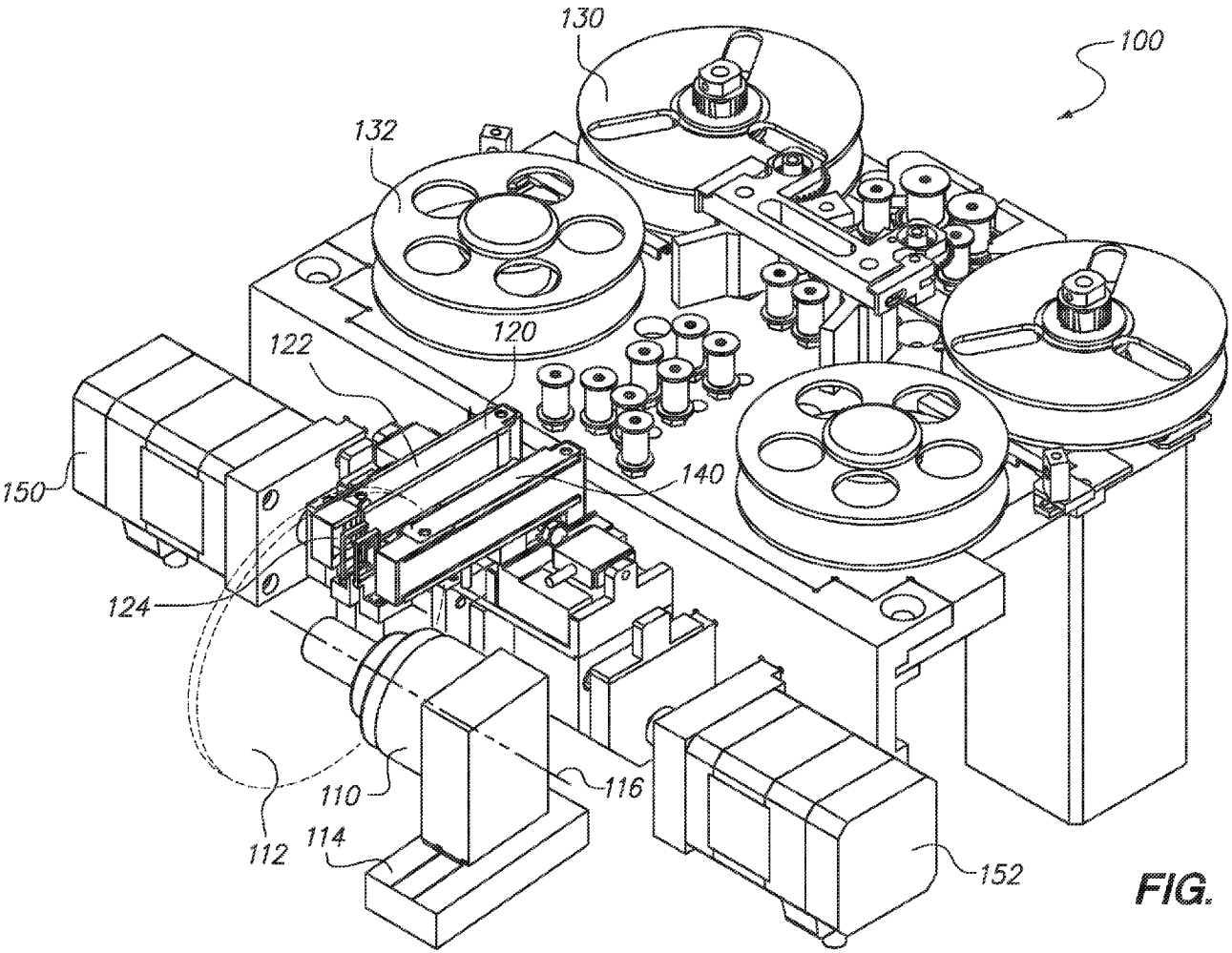
FIG. 1 is a perspective view of a disk buffing apparatus capable of including an embodiment of the present invention.

FIG. 1 is a perspective view of a disk buffing apparatus 100 capable of including an embodiment of the present invention. In the embodiment of FIG. 1, the disk buffing apparatus 100 includes a spindle 110 for rotating an annular disk 112 about a spindle axis of rotation 116, and a first pad arm 120 for loading an abrasive tape against a first surface of the annular disk 112. The abrasive tape is not shown in the view of FIG. 1, because the abrasive tape is a disposable material that is used by the tape buffing apparatus 100, rather than being considered part of the disk buffing apparatus 100. However, in the embodiment of FIG. 1, the disk buffing apparatus 100 includes spools 130, 132 for storing and taking up the abrasive tape as it is being used.

In the embodiment of FIG. 1, the first pad arm 120 may include a pad arm frame 122 having a pad receptacle 124. The pad arm frame 122 may comprise aluminum or steel, for example. The disk buffing apparatus 100 may optionally also include a second pad arm 140, for loading an abrasive tape against an opposing second surface of the annular disk 112. The disk buffing apparatus may also include stepper motors 150, 152 that move the first pad arm 120 toward and/or away from the second pad arm 140, and in some embodiments, the second pad arm 140 toward and/or away from the first pad arm 120.

In the embodiment of FIG. 1, the tape buffing apparatus 100 further optionally includes a translation stage 114 that translates the spindle 110 in a direction normal to the axis of rotation 116, to change the buffing radius at which the abrasive tape is loaded against the surface of the disk 112. Preferably but not necessarily, an angular velocity of the spindle 110 is controlled to be inversely proportional to the buffing radius, so that the surface of the annular disk 112 will move relative to the abrasive tape at a constant linear velocity. In some embodiments, the linear velocity due to spindle rotation may preferably be in the range of 30 to 400 m/min at the buffing radius.

Figure 2:
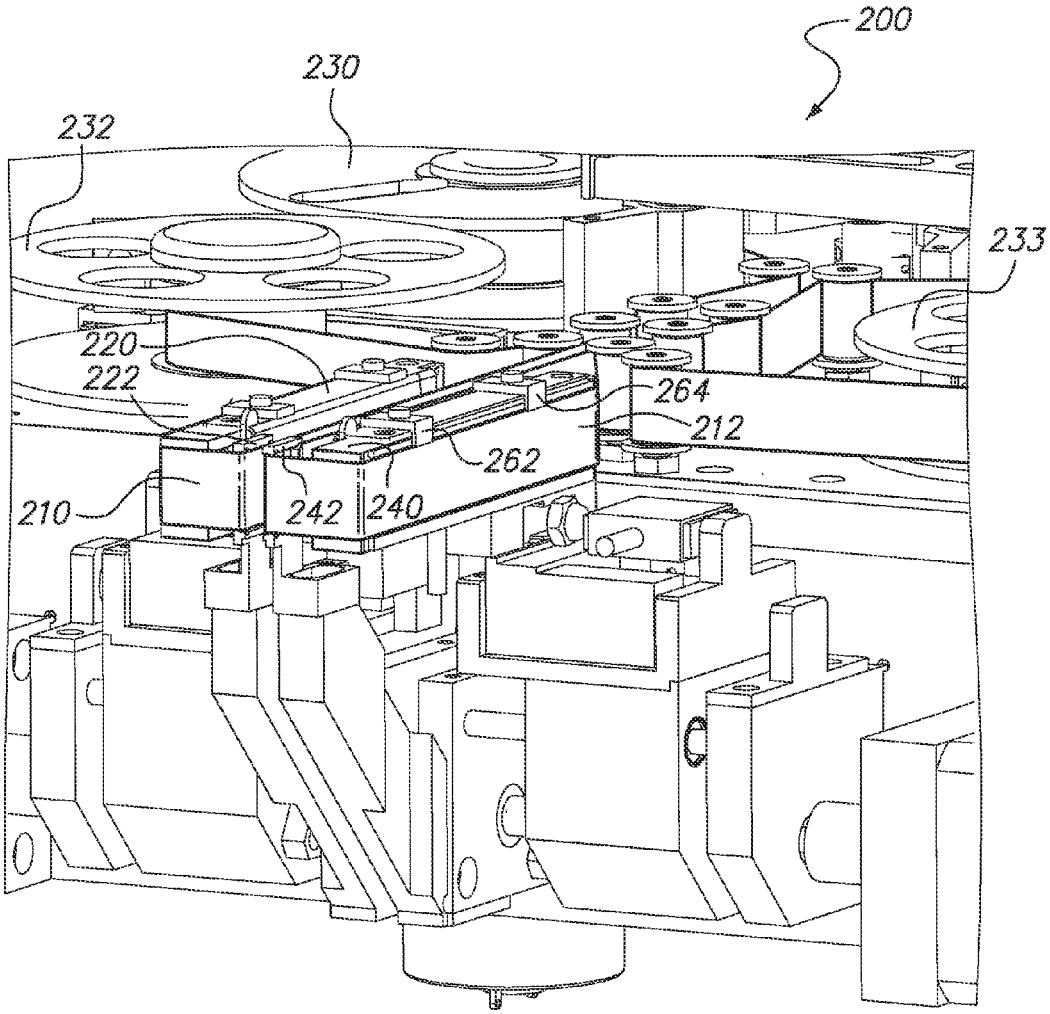
FIG. 2 is a perspective view of a region of a disk buffing apparatus, with abrasive tape supported by pad arms and tape guides, that is capable of including an embodiment of the present invention.

FIG. 2 is a perspective view of a region of a disk buffing apparatus 200, with an abrasive tape 210 and an abrasive tape 212. The abrasive tape 210 is stored and taken up by spools 230, 232 and the abrasive tape 210 is supported by a first pad arm 220 and by a tape guide 222. The abrasive tape 212 is stored or taken up by a spool 233, and the abrasive tape 212 is supported by a second pad arm 240 and by tape guides 242, 262, and 264. The abrasive tape 210 and the abrasive tape 212 may optionally include hard particles (e.g. alumina particles, diamond particles, or silicon oxide particles) adhered to a flexible polyethylene terephthalate tape substrate by an adhesive film. The first pad arm 220 and the second pad arm 240 are for loading the abrasive tapes 210 and 212 against opposing surfaces of an annular disk (e.g. annular disk 112 of FIG. 1).

Figure 3:
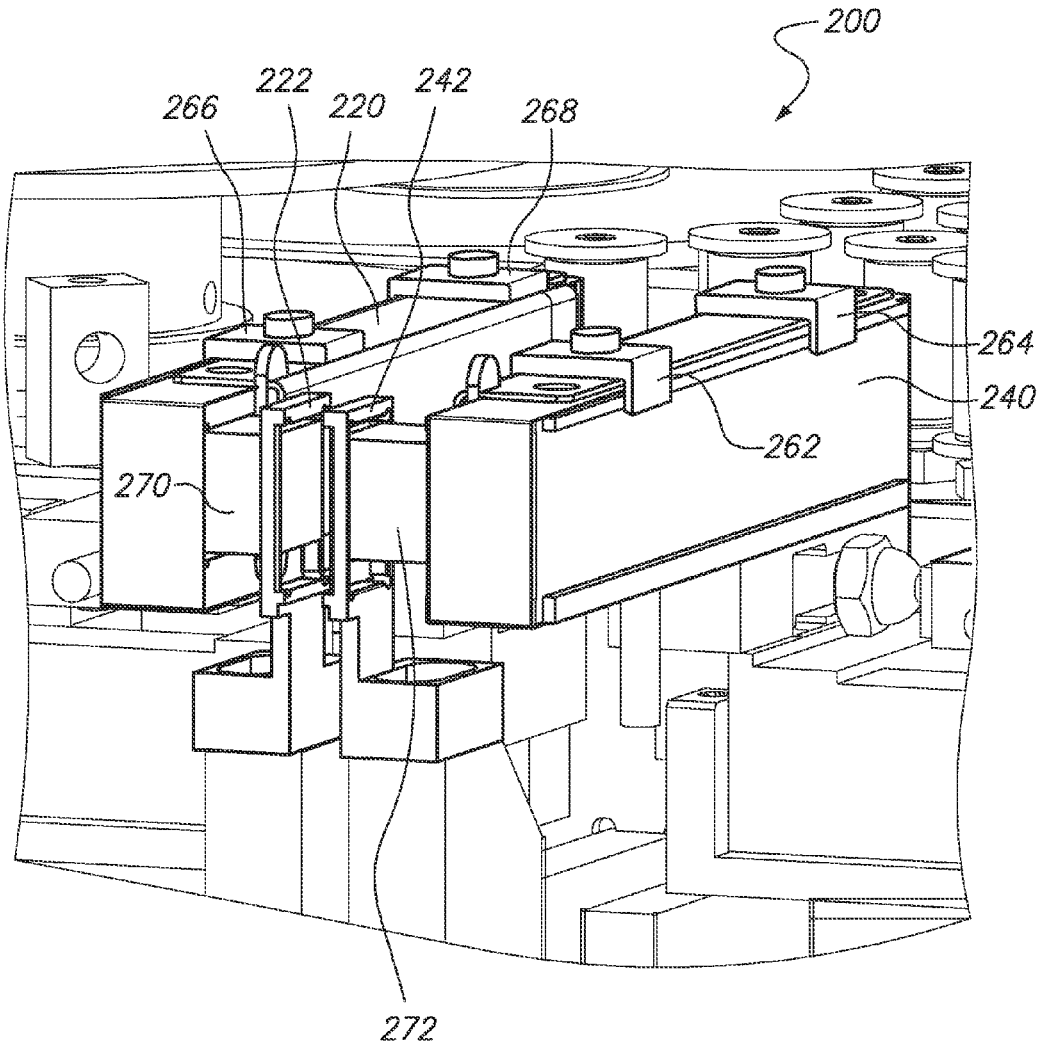
FIG. 3 is a perspective view of a region of a disk buffing apparatus, with pad arms, tape loading pads, and tape guides, capable of including an embodiment of the present invention.

FIG. 3 is a closer perspective view of a region of the disk buffing apparatus 200, in a non-operational state without abrasive tape. In the embodiment of FIG. 3, the first pad arm 220 includes the tape guide 222 and tape guides 266, 268. The second pad arm 240 includes the tape guides 242, 262, and 264. FIG. 3 also shows that the first pad arm 220 includes a first pad 270, and the second pad arm 240 includes a second pad 272. Preferably the structure of the first and second pads 270, 272 is the same.

Figure 4:
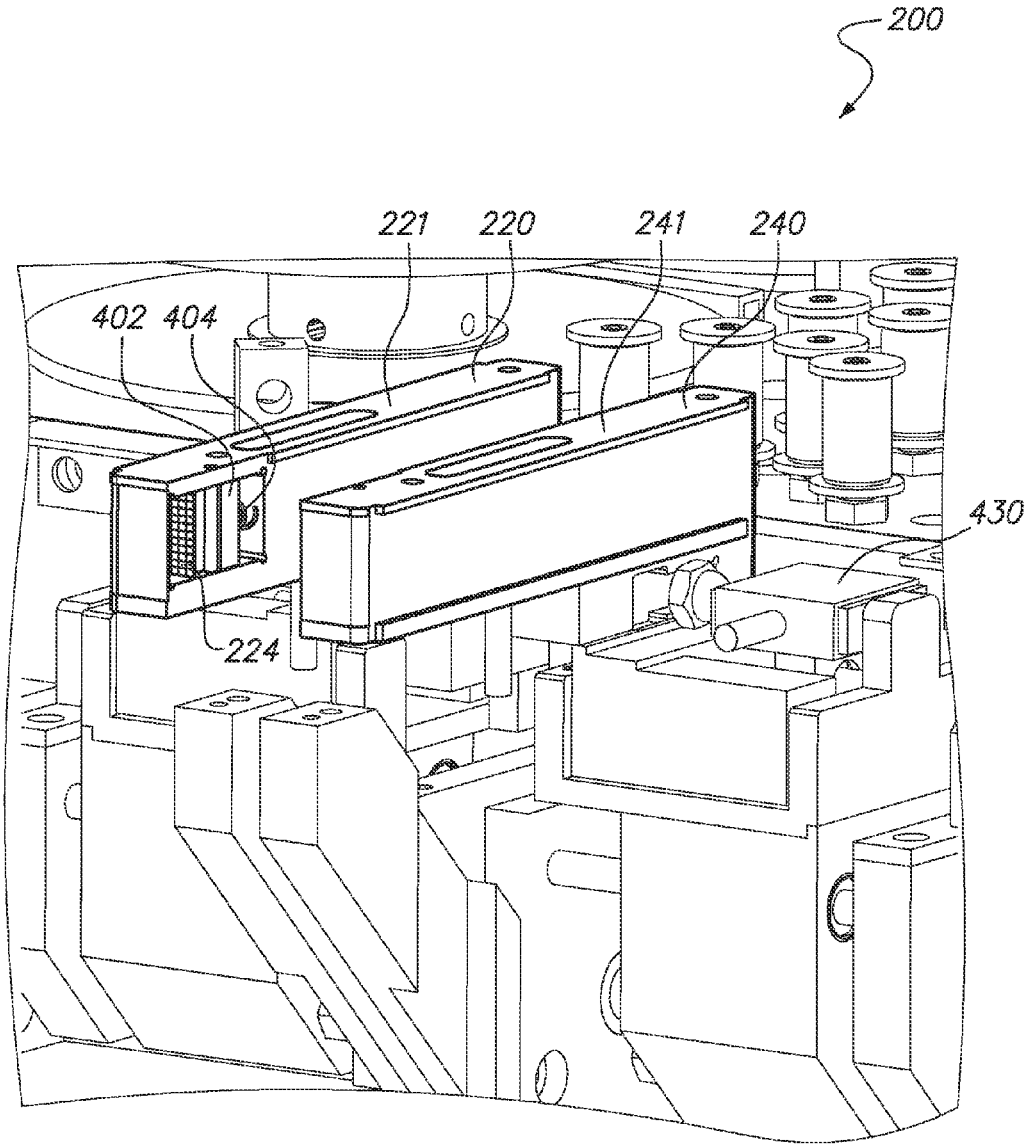
FIG. 4 is a perspective view of a region of a disk buffing apparatus with pad arms and pad clamps, capable of including an embodiment of the present invention.
Figure 5:
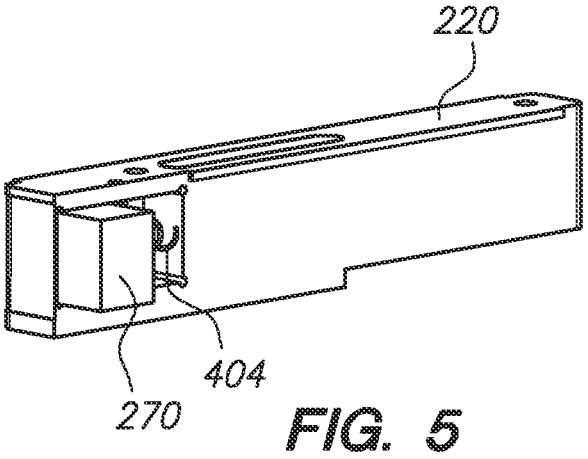
FIG. 5 is a perspective view of a pad arm clamping a tape loading pad that is capable of including an embodiment of the present invention.

FIG. 4 is a perspective view of the region of the disk buffing apparatus 200, in a non-operational state without abrasive tape, and with the tape guides and pads removed from the first and second pad arms 220, 240. In the embodiment of FIG. 4, the first pad arm 220 includes a first pad arm frame 221 that includes a pad receptacle 224. The second pad arm 240 includes a second pad arm frame 241 that also includes a pad receptacle (not visible in the view of FIG. 4). Preferably the structure of the second pad arm 240 is like that of the first pad arm 220. The pad receptacle 224 includes a pad clamp 402 that is forced into the pad receptacle 224 by a clamping spring 404. The function of the clamping spring 404 is better depicted in FIG. 5, which shows that the clamping spring 404 forces the pad clamp against a pad 270, and thereby clamps the pad 270 within the pad receptacle.

Figure 6:
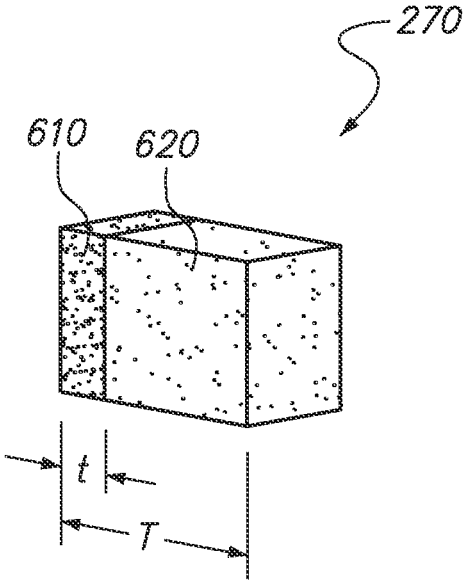
FIG. 6 depicts a tape loading pad according to an embodiment of the present invention.

FIG. 6 depicts a pad 270 for abrasive tape loading, according to an embodiment of the present invention. In the embodiment of FIG. 6, the pad 270 has a damping layer 610 and a tape loading layer 620. Now referring to FIGS. 4-6, the damping layer 610 is in contact with the first pad arm 220, when the pad 270 is clamped within the pad receptacle 224 by the pad clamp 402. Now referring to FIGS. 2-6, the tape loading layer contacts the abrasive tape 210 and presses it against a surface of the annular disk being buffed (e.g. annular disk 112 of FIG. 1). In the embodiment of FIG. 6, the damping layer 610 comprises a first polymeric material and the tape loading layer 620 comprises a second polymeric material, and the first polymeric material has a lesser hardness than the second polymeric material.

In certain embodiments, the first polymeric material preferably comprises a polyurethane foam, and the second polymeric material optionally comprises a fluoro-elastomer. In certain embodiments the first polymeric material preferably has a hardness in the range of 2 to 40 Shore 0 Durometers and the second polymeric material optionally has a hardness in the range of 50 to 100 Shore A Durometers. In the embodiment of FIG. 6, a thickness t of the first damping layer is in the range of 10% to 30% of a combined thickness T of both the first damping layer and the first tape loading layer. In certain embodiments, the first polymeric material preferably has a bulk density in the range of 15 to 20 $lb/ft^3$ and the second polymeric material optionally has a bulk density in the range of 109-119 $lb/ft^3$. In certain embodiments, one or more of the foregoing geometry and/or material property ranges can advantageously reduce detrimental vibration in which the tape 210 and pad 270 can bounce on the surface of the disk (e.g. disk 112 of FIG. 1), and thereby reduce degradation of the tape or disk surface quality.

As can be understood by FIGS. 2-6, the first abrasive tape 210 and the second abrasive tape 212, and the annular disk (e.g. annular disk 112 of FIG. 1) may be all disposed between the first pad 270 and the second pad 272, and more specifically between the tape loading layer 620 of the first pad 270 and the tape loading layer of the second pad 272 (which faces the tape loading layer 620 of the first pad 270). Optionally, the first pad arm 220 may load the abrasive tape 210 against a surface of the annular disk with a first load force, and the second pad arm 240 may load the abrasive tape 212 against an opposing surface of the annular disk with a second load force that is approximately equal and opposite the first load force. The disk buffing apparatus may include one or more conventional load force transducers (e.g. load force transducer 430 of FIG. 4) that can sense the first load force and/or the second load force. In certain embodiments, the first load force and/or the second load force may preferably be in the range of 1 to 5 Newtons. In certain embodiments, a pressure between the abrasive tape 210 and the surface of the annular disk may preferably be in the range 1.5 to 8 N/cm2.

In the foregoing specification, the invention is described with reference to specific exemplary embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably," and the phrase "preferably but not necessarily," are used synonymously herein to consistently include the meaning of "not necessarily" or optionally. "Comprising," "including," and "having," are intended to be open-ended terms.

What is claimed is:

1. A disk buffing apparatus comprising:
- a spindle for rotating an annular disk;
- a first pad arm for loading a first abrasive tape against a first surface of the annular disk, the first pad arm including
  - a pad arm frame having a pad receptacle, and
  - a first pad having
    - a first damping layer in contact with the first pad arm within the pad receptacle, and
    - a first tape loading layer for contacting the first abrasive tape;
  - wherein the first damping layer comprises a first polymeric material and the first tape loading layer comprises a second polymeric material, and the first polymeric material has a lesser hardness than the second polymeric material,
  - wherein the first and second polymeric material are configured such that the first pad dampens vibration, and
  - wherein a thickness of the first damping layer is in the range of 10% to 30% of a combined thickness of both the first damping layer and the first tape loading layer.

2. The disk buffing apparatus of claim 1 wherein the first polymeric material comprises a polyurethane foam.

3. The disk buffing apparatus of claim 1 wherein the second polymeric material comprises a fluoro-elastomer.

4. The disk buffing apparatus of claim 1 wherein the first polymeric material has a hardness in the range of 2 to 40 Shore O Durometers.

5. The disk buffing apparatus of claim 1 wherein the second polymeric material has a hardness in the range of 50 to 100 Shore A Durometers.

6. The disk buffing apparatus of claim 1 further comprising a first tape guide that guides the first abrasive tape from a first spool to the first tape loading layer.

7. The disk buffing apparatus of claim 1 wherein the first polymeric material has a bulk density in the range of 15 to 20 $lb/ft^3$.

8. The disk buffing apparatus of claim 7 wherein the second polymeric material has a bulk density in the range of 109-119 $lb/ft^3$.

9. The disk buffing apparatus of claim 1 further comprising a second pad arm for loading a second abrasive tape against a second surface of the annular disk, the second pad arm including a second pad that comprises a second damping layer in contact with the second pad arm, and a second tape loading layer for contacting the second abrasive tape, the second tape loading layer facing the first tape loading layer, wherein the second damping layer comprises the first polymeric material and the second tape loading layer comprises the second polymeric material.

10. The disk buffing apparatus of claim 9 wherein the first abrasive tape and the second abrasive tape and the annular disk are all disposed between the first and second tape loading layers.

11. The disk buffing apparatus of claim 9 wherein the first pad arm is movable towards the second pad arm, and the second pad arm is movable towards the first pad arm.

12. The disk buffing apparatus of claim 11 further comprising at least one stepper motor that moves the first pad arm towards the second pad arm.

13. The disk buffing apparatus of claim 11 wherein the first pad arm loads the first abrasive tape against the first surface of the annular disk with a first load force, and the second pad arm loads the second abrasive tape against the second surface of the annular disk with a second load force that is approximately equal and opposite the first load force.

14. The disk buffing apparatus of claim 13 further comprising a load force transducer that senses the first load force.

15. The disk buffing apparatus of claim 13 wherein the first load force is in the range of 1 to 5 Newtons.

16. The disk buffing apparatus of claim 9 further comprising a first tape guide that guides the first abrasive tape from a first spool to the first tape loading layer, and further comprising a second tape guide that guides the second abrasive tape from a second spool to the second tape loading layer.

17. The disk buffing apparatus of claim 1 wherein a pressure between the first abrasive tape and the first surface of the annular disk is in the range 1.5 to 8 $N/cm^2$.

18. The disk buffing apparatus of claim 1 wherein the pad receptacle includes a pad clamp that is forced against the first pad by a clamping spring.

19. The disk buffing apparatus of claim 1 wherein the first abrasive tape is loaded against the first surface of the annular disk at a buffing radius, and wherein the first surface of the annular disk moves relative to the first abrasive tape at a constant linear velocity in the range of 30 to 400 m/min at the buffing radius due to spindle rotation.

20. The disk buffing apparatus of claim 19 wherein the spindle defines an axis of rotation, and further comprising a translation stage that translates the spindle in a direction normal to the axis of rotation to change the buffing radius, and wherein an angular velocity of the spindle is inversely proportional to buffing radius.

* * * * *